US006739303B2

(12) United States Patent
Harada et al.

(10) Patent No.: US 6,739,303 B2
(45) Date of Patent: May 25, 2004

(54) RECOIL STARTER

(75) Inventors: Takayuki Harada, Tokyo (JP); Taro Kihara, Tokyo (JP)

(73) Assignee: Starting Industrial Co., Ltd., Tokyo (JP)

( * ) Notice: Subject to any disclaimer, the term of this patent is extended or adjusted under 35 U.S.C. 154(b) by 38 days.

(21) Appl. No.: 10/194,320

(22) Filed: Jul. 15, 2002

(65) Prior Publication Data

US 2003/0015162 A1 Jan. 23, 2003

(30) Foreign Application Priority Data

Jul. 18, 2001 (JP) ..... 2001-217968

(51) Int. Cl.[7] ..... F02N 3/02
(52) U.S. Cl. ..... 123/185.14; 123/185.3
(58) Field of Search ..... 123/185.14, 185.2, 123/185.3, 185.4; 192/42

(56) References Cited

U.S. PATENT DOCUMENTS 5,287,832 A 2/1994 Uhl
5,862,787 A * 1/1999 Unuma et al. ..... 123/185.3

FOREIGN PATENT DOCUMENTS

JP 07-017810 Y2 4/1995

OTHER PUBLICATIONS

Morishige Toshinori et al, Patent Abstracts of Japan, Recoil Starter, Publication No. 2002–138929, May 17, 2002, Application No. 2000–337487 filed Nov. 11, 2000, Starting Ind. Co. Ltd., Japan.

* cited by examiner

*Primary Examiner*—Andrew M. Dolinar
(74) *Attorney, Agent, or Firm*—Breiner & Breiner, L.L.C.

(57) ABSTRACT

A recoil starter featuring a capability of efficiently cooling an engine, easy fabrication and handlings of a power storage spiral spring and an enhanced assemblability is provided. The recoil starter comprises: a starter case unitary with a starter shaft; a one way clutch mechanism comprising a cylinder cam mounted to the starter shaft, a cup-shaped pulley mounted on an engine side, and a ratchet mechanism mounted to the pulley or the cylinder cam and brought into or out of engagement with the cylinder cam or the cup-shaped pulley; a reel pivotally mounted to the starter shafts; a recoil spiral spring anchored to the starter case and the reel at both ends thereof and biased in a direction to wind up the rope; and a power storage spiral spring accommodated in a cassette type spring case and operative to resiliently transmit a reel torque to the cylinder cam when the rope is pulled out, wherein air inlet ports for introducing a cooling air for engine are disposed at an outside surface and outer periphery of the starter case, a side surface of the reel and a side surface of the spring case for the power storage spiral spring.

7 Claims, 6 Drawing Sheets

RECOIL STARTER

BACKGROUND OF THE INVENTION

1. Field of the Invention

The present invention relates to a recoil starter for use as an engine starter and more particularly to an improved method for introducing a cooling air for engine, the method applied to the recoil starter including therein a power storage spiral spring.

2. Description of the Related Art

In general, the recoil starter of this type adopts a system wherein a rope wound around a rotary reel is pulled out thereby starting the engine via a one way clutch mechanism and the rope is wound up by a rewinding force of the spiral spring. The recoil starters of power storage type have been proposed in the art. For instance, a recoil starter (see Japanese Utility Model Publication No. 17810/1995 comprises: a starter pulley having a ratchet wheel engageable with a ratchet claw of a crankshaft; a power storage spiral spring adapted to store a driving force which is exerted on the starter pulley for bringing the crankshaft into rotation; and a recoil drum designed to be rotated through a predetermined number of revolutions for permitting the power storage spiral spring to store a predetermined amount of power, the recoil starter arranged such that the rotation of the crankshaft is inhibited until a predetermined amount of power is stored by the spiral spring, the spiral spring is wound up through a predetermined number of revolutions after the establishment of meshing engagement between the ratchet claw of the crankshaft and the ratchet wheel of the starter pulley, and the spiral spring wound up through the predetermined number of revolutions automatically carries out the activation of an engine. Another recoil starter (see Japanese Patent Application No.2000-337487) comprises a starter case having a bearing disposed on an axis of a crankshaft in face-to-face relation therewith; apivotally movable starter shaft inserted in the bearing; a one way clutch mechanism including one end of the starter shaft that extends from the bearing toward a crankshaft side and a part belonging to an engine; and a starter case unitary with the starter case and having a bearing for supporting the other end of the starter shaft; a reel pivotally mounted to the starter shaft as interposed between the above two bearings; a rope wound around a groove of the reel; a recoil spiral spring anchored to the starter case and the reel at both ends thereof and biased in a direction to wind up the rope; and a power storage spiral spring anchored to the reel and the starter shaft at both ends thereof and operative to resiliently transmit a reel torque to the starter shaft when the rope is pulled out.

Unfortunately, however, the aforementioned power storage type recoil starters of the prior art have the following problems.

In a case where the above recoil starter of power storage type is applied to a recoil starter of a type which is adapted to introduce a cooling air for engine from a recoil starter side including the rope, reel, recoil spiral spring and the like, a complicated internal structure only permits a method to introduce the cooling air only from a peripheral side of the starter case and hence, an efficient cooling of the engine cannot be accomplished. In addition, the conventional power storage spiral springs have a relatively large size because they require as much damping force as to oppose a starting resistance of the engine. As a result, the conventional power storage spiral springs encounter difficulties in fabrication and handlings thereof.

SUMMARY OF THE INVENTION

The invention has been accomplished for the purpose of overcoming the drawbacks of the prior art and has an object to provide a recoil starter of a power storage type which is easily applied to the recoil starter of the type wherein the cooling air for engine is introduced from the recoil starter side, and which features a capability of efficiently cooling the engine, easy fabrication and handlings of the power storage spiral spring and an enhanced assemblability.

A recoil starter according to the invention comprises: a starter case unitary with a starter shaft disposed on an axis of a crankshaft in face-to-face relation therewith; a one way clutch mechanism comprising a cylinder cam pivotally fitted on the starter shaft, a cup-shaped pulley mounted on an engine side, and a ratchet mechanism mounted to the pulley and brought into or out of engagement with the cylinder cam; a reel pivotally mounted to the starter shaft; a rope wound around a groove of the reel; a recoil spiral spring anchored to the starter case and the reel at both ends thereof and biased in a direction to wind up the rope; and a power storage spiral spring accommodated in a cassette type spring case and operative to resiliently transmit a reel torque to the cylinder cam when the rope is pulled out, wherein air inlet ports for introducing a cooling air for engine are disposed at an outside surface and outer periphery of the starter case, a side surface of the reel and a side surface of the spring case for the power storage spiral spring.

Another recoil starter according to the invention comprises: a starter case unitary with a starter shaft disposed on an axis of a crankshaft in face-to-face relation therewith;

a one way clutch mechanism comprising a cylinder cam pivotally fitted on the starter shaft, and a ratchet mechanism in which a ratchet pivotally mounted to the cylinder cam is brought into or out of engagement with a cup-shaped pulley mounted on an engine side; a reel pivotally mounted to the starter shaft; a rope wound around a groove of the reel; a recoil spiral spring anchored to the starter case and the reel at both ends thereof and biased in a direction to wind up the rope; and a power storage spiral spring accommodated in a cassette type spring case and operative to resiliently transmit a reel torque to the cylinder cam when the rope is pulled out, wherein air inlet ports for introducing a cooling air to said starter are disposed at an outside surface and outer periphery of the starter case, a side surface of the reel and a side surface of the spring case for the power storage spiral spring.

The recoil starter is further characterized in that a substantially U-shaped notch provided at an outer end of the power storage spiral spring is designed to engage with a projection formed by inwardly projecting a portion of a circumference of the spring case; in that a projection formed at the spring case for the power storage spiral spring is inserted through the reel and fixed thereto by folding a distal end of the projection; in that a part of the cylinder cam pivotally fitted on the starter shaft is inserted in a central hole in a bottom of the cup-shaped pulley whereas the ratchet of the one way clutch mechanism mounted within the cup-shaped pulley is deployed by a centrifugal force thereby to disengage from the cylinder cam; and in that the starter shaft has a two stage structure including a greater diameter portion closer to the reel and a smaller diameter portion defining a distal end portion of the shaft whereas the cylinder cam is fitted on the starter shaft as covering the smaller diameter portion and a part of the greater diameter portion

DESCRIPTION OF THE PREFERRED EMBODIMENTS

Figure 1:
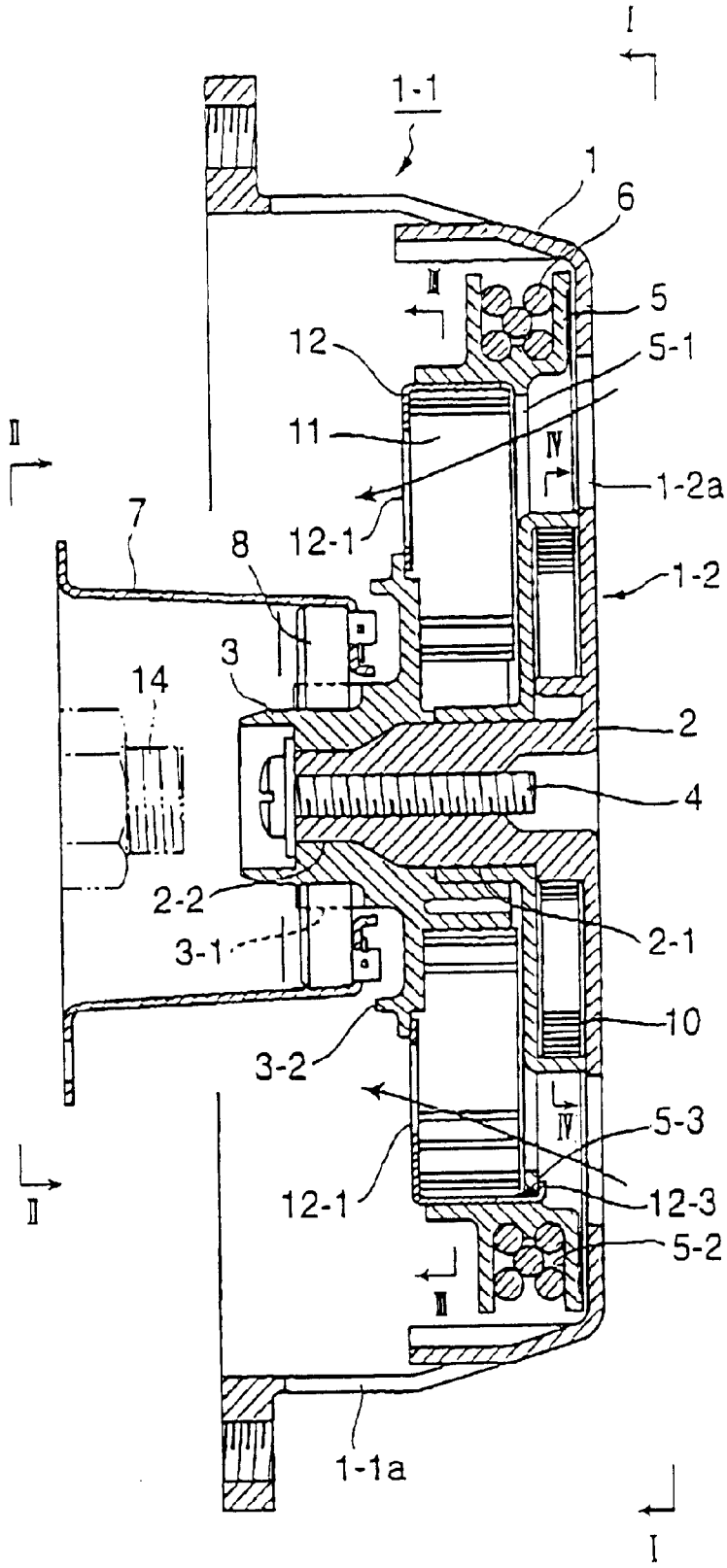
FIG. 1 is a side view in vertical section for illustrating a recoil starter according to one embodiment of the invention.
Figure 2:
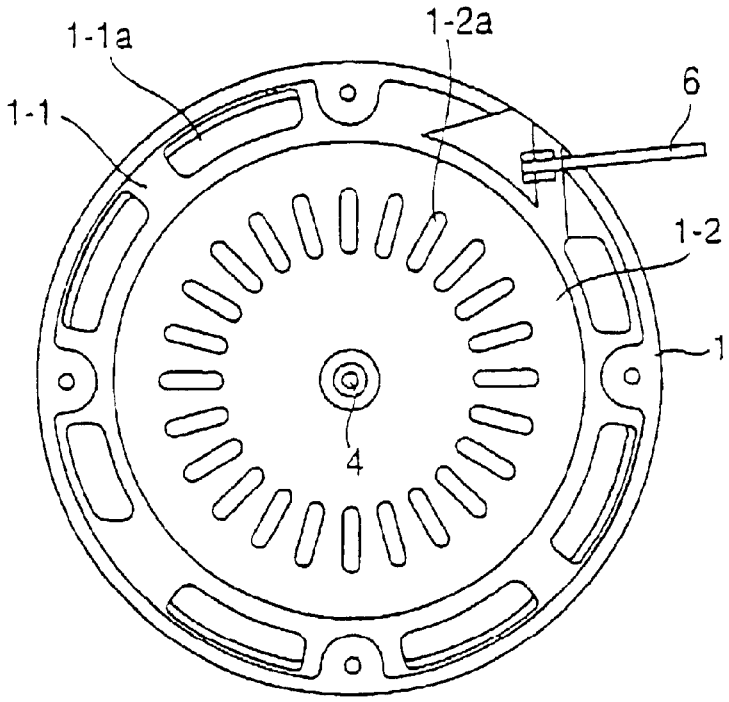
FIG. 2 is a foreshortened view taken on the line I—I in FIG. 1.
Figure 3:
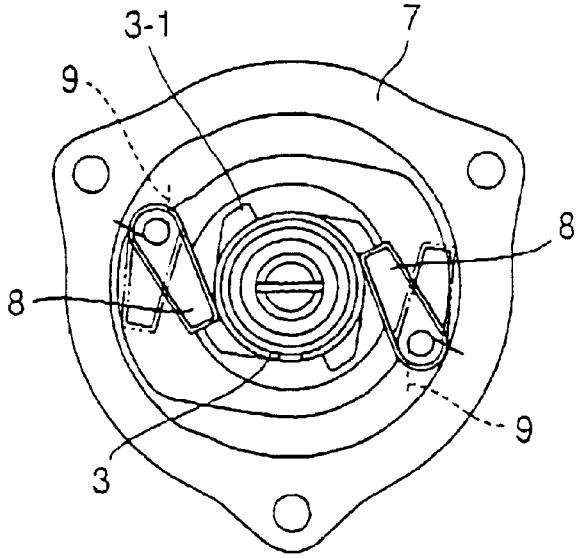
FIG. 3 is a view taken on the line II—II in FIG. 1.
Figure 4:
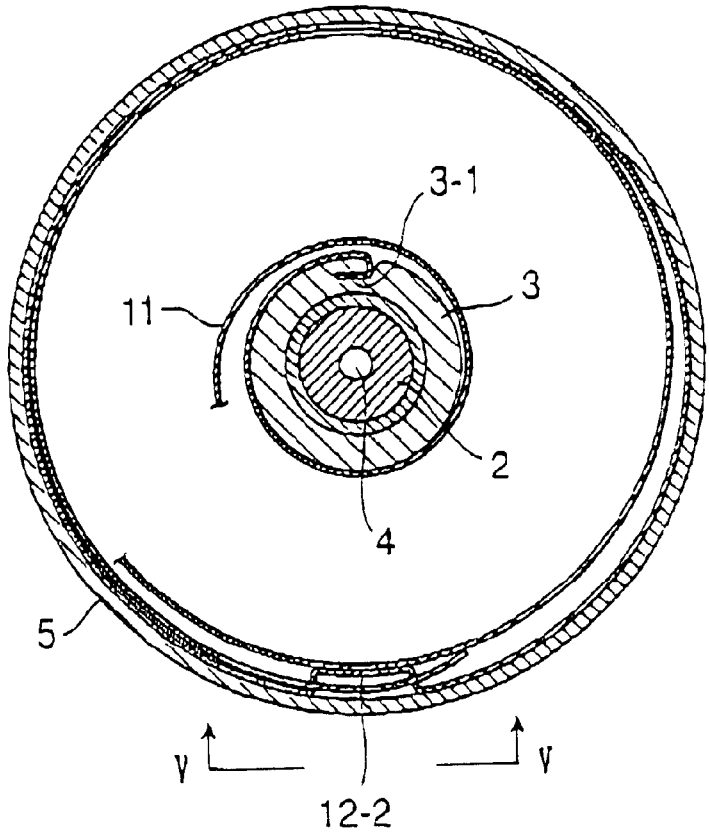
FIG. 4 is a partially omitted view in vertical section taken on the line III—III in FIG. 1.
Figure 5:
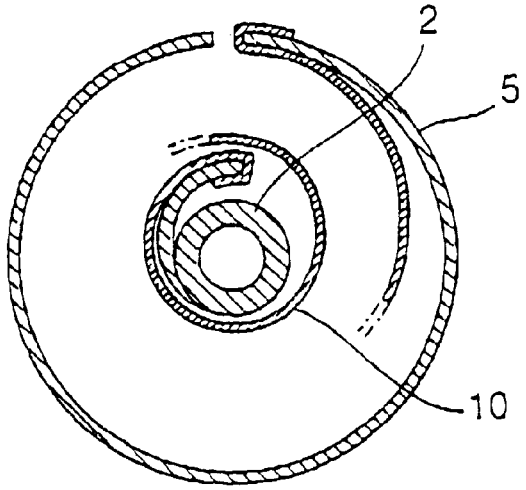
FIG. 5 is a partially omitted view in vertical section taken on the line IV—IV in FIG. 1.
Figure 6:
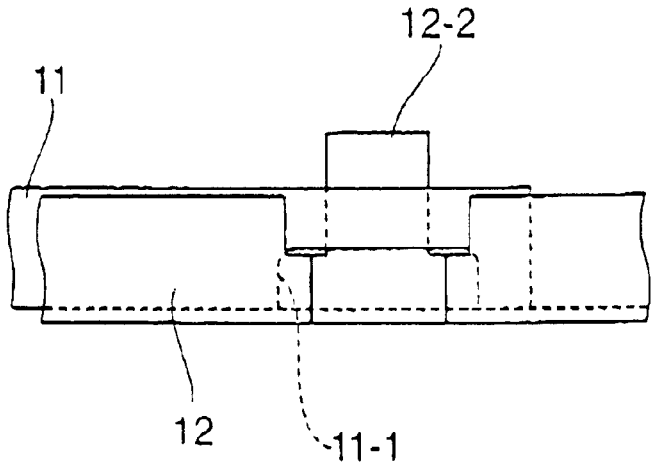
FIG. 6 is a view taken on the line V—V in FIG. 4.
Figure 7:
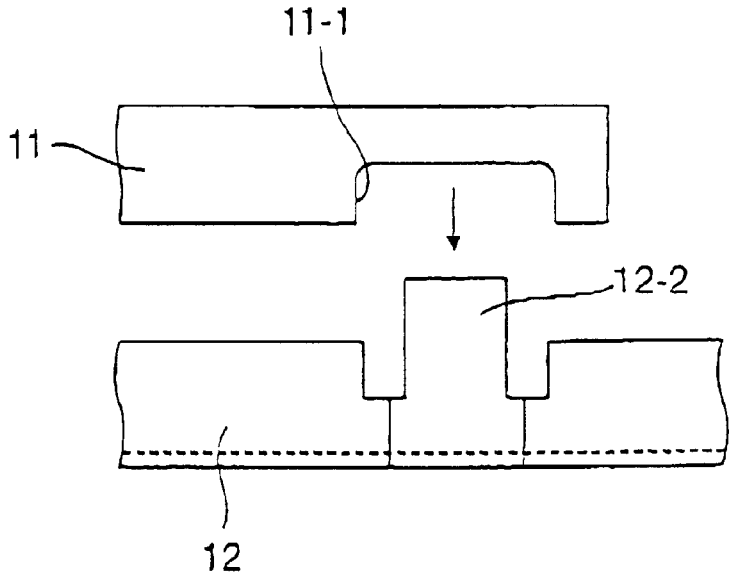
FIG. 7 is a disassembled view showing the parts of FIG. 6.
Figure 8:
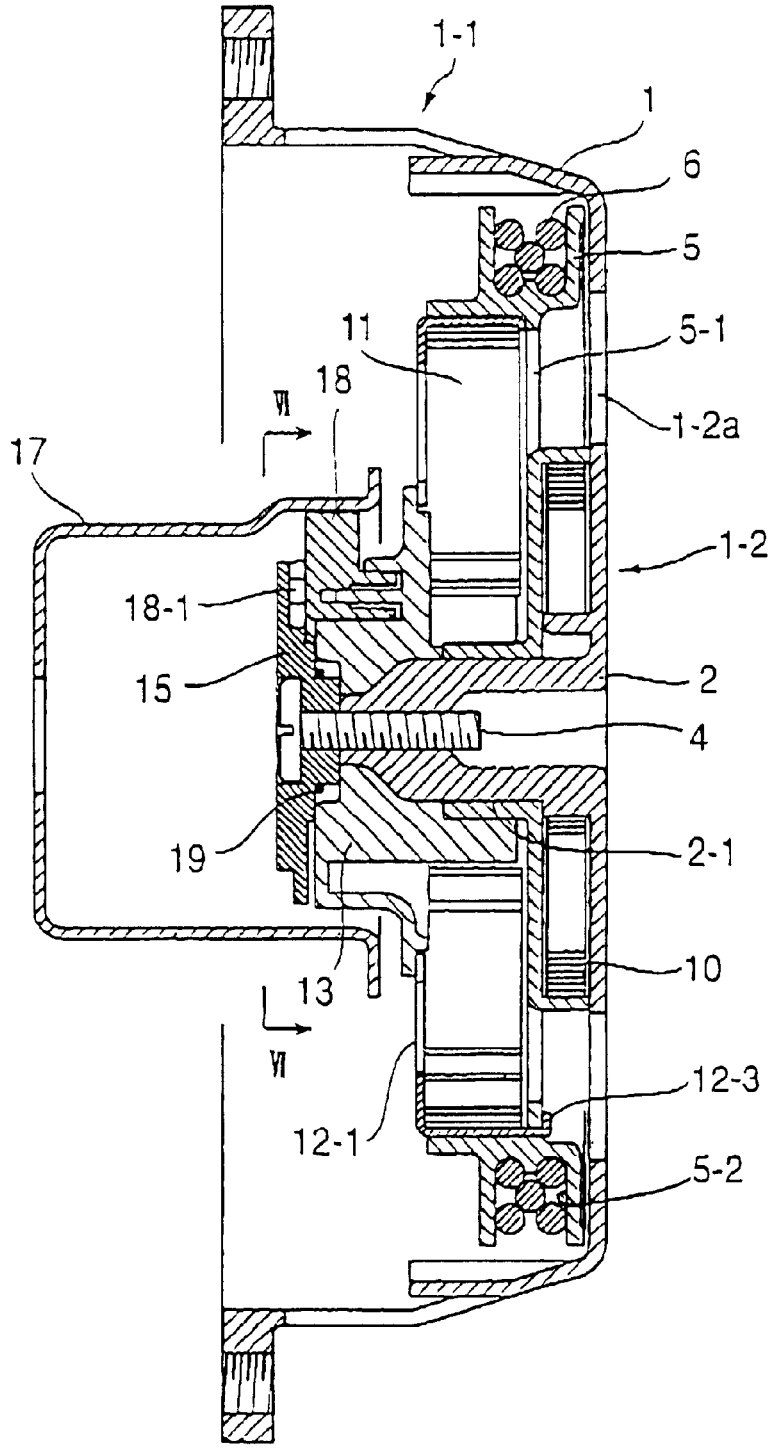
FIG. 8 is a side view in vertical section for illustrating a recoil starter according to another embodiment of the invention.
Figure 9:
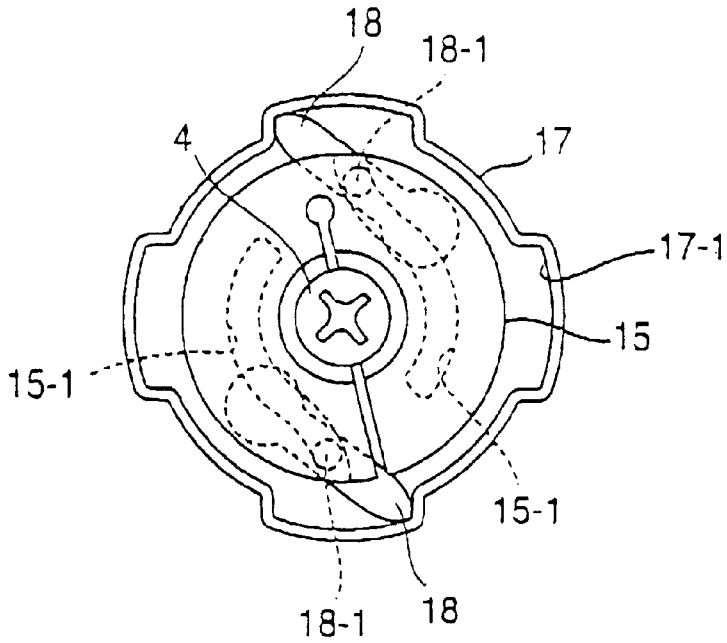
FIG. 9 is a foreshortened view taken on the line VI—VI in FIG. 8 for illustrating a pre-start state of there coil starter of FIG. 8.
Figure 10:
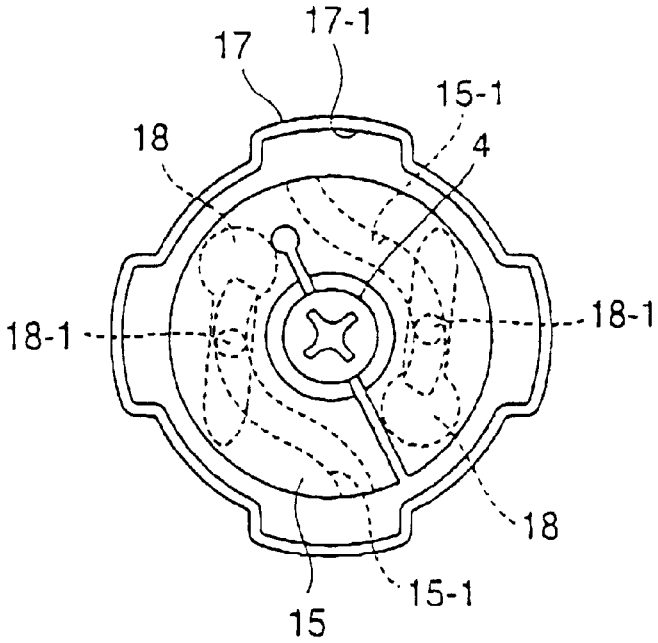
FIG. 10 is a view in correspondence to FIG. 9 for illustrating a post-start state of the recoil starter of FIG. 8.

FIG. 1 is a side view in vertical section for illustrating a recoil starter according to one embodiment of the invention. FIG. 2 is a foreshortened view taken on the line I—I in FIG. 1. FIG. 3 is a view taken on the line II—II in FIG. 1. FIG. 4 is a partially omitted view in vertical section taken on the line III—III in FIG. 1. FIG. 5 is a partially omitted view in vertical section taken on the line IV—IV in FIG. 1. FIG. 6 is a view taken on the line V—V in FIG. 4. FIG. 7 is a disassembled view showing the parts of FIG. 6. FIG. 8 is a side view in vertical section for illustrating a recoil starter according to another embodiment of the invention. FIG. 9 is a foreshortened view taken on the line VI—VI in FIG. 8 for illustrating a pre-start state of the recoil starter of FIG. 8, whereas FIG. 10 is a view in correspondence to FIG. 9 for illustrating a post-start state of the recoil starter of FIG. 8. A reference character 1 represents a starter case; a character 1—1 representing an outer periphery; a character 1-2 representing an outside surface; characters 1-1*a*, 1-2*a* each representing an air inlet port; a character 2 representing a starter shaft; a character 2-1 representing a greater diameter portion; a character 2—2 representing a smaller diameter portion; characters 3, 13 each representing a cylinder cam; a character 4 representing a set screw; a character 5 representing a reel; a character 5-1 representing an air inlet port; a character 6 representing a rope; characters 7, 17 each representing a cup-shaped pulley; characters 8, 18 each representing a ratchet; a character 9 representing a return spring; a character 10 representing a recoil spiral spring; a character 11 representing a power storage spiral spring; a character 12 representing a spring case; a character 12-1 representing an air inlet port; a character 14 representing a crankshaft; a character 15 representing a friction plate; a character 19 representing a friction spring.

Referring to FIGS. 1 to 5, the starter case 1 is integrally formed with the starter shaft 2 at a central portion thereof, the starter shaft disposed on an axis of the crankshaft 14 in face-to-face relation therewith. The starter case is also formed with the air inlet ports 1-1*a*, 1-2*a* at respective places of the outer periphery 1—1 and the outside surface 1-2 thereof. The air inlet port 1-1*a* is formed data slope of the outer periphery 1—1 whereas the air inlet port 1-2*a* is formed at a flat portion of the outside surface 1-2. It is noted that the size and shape of the air inlet ports 1-1*a*, 1-2*a* are not limited to those shown in the figure.

On a crank shaft 14 side of the starter shaft 2, the cylinder cam 3 is pivotally fitted by means of the set screw 4. The starter shaft 2 includes the greater diameter portion 2-1 and the smaller diameter portion 2—2 The cylinder cam 3 is pivotally fitted on the starter shaft as covering the smaller diameter portion 2—2 and a part of the greater diameter portion 2-1 and is secured to the starter shaft 2 by means of the set screw 4. A one way clutch mechanism is arranged as follows. The cylinder cam 3 pivotally fitted on the starter shaft 2 is partially inserted in a hole centrally formed in a bottom of the cup-shaped pulley 7, whereas the ratchet 8 mounted within the cup-shaped pulley 7 is in meshing relation with a cam portion 3-1 and is inwardly biased by a return spring 9.

Pivotally mounted to the greater diameter portion 2-1 of the starter shaft 2 is the reel 5 with the rope 6 wound around a reel groove 5-2 formed on an outer periphery thereof. The reel is formed with the air inlet port 5-1 which is resemblant to the air inlet port 1-2*a* formed in the outside surface 1-2 of the starter case 1 and is substantially in corresponding relation there with. There coil spiral spring 10 is accommodated in a space between the reel 5 and the starter case 1. The recoil spiral spring is anchored to the starter case and the reel at both ends thereof and is biased in a direction to wind up the rope 6. In addition, the power storage spiral spring 11 is accommodated in a cassette type spring case 12 on a crankshaft 14 side of the reel 5, the power storage spring operative to resiliently transmit a torque of the reel 5 to the cylinder cam 3 when the rope 6 is pulled out. The spring case 12 is also formed with the air inlet port 12-1 substantially in corresponding relation with the air inlet port 5-1 formed at the reel 5.

The power storage spiral spring 11 has its outer end engaged with the spring case 12 and its inner end engaged with the cylinder cam 3. In this case, means for engagement between the outer end of the power storage spiral spring 11 and the spring case 12 may employ a method, as shown in FIGS. 6 and 7, wherein a substantially U-shaped notch 11-1 provided at the outer end of the power storage spiral spring 11 is engaged with a projection 12-2 formed by inwardly projecting a portion of a circumference of the spring case 12. On the other hand, means for engagement between the inner end of the power storage spiral spring 11 and the cylinder cam 3 may employ a method wherein the inner end of the spiral spring 11 is engaged with a groove 3-1 formed at the cylinder cam 3.

As means for fixing the cassette type spring case 12, there may be used a method wherein the spring case 12 is fitted in a space between an end of a flange 3-2 projected from the cylinder cam 3 in a direction perpendicular to the axis of the starter shaft 2 and the reel 5, while a projection 12-3 formed at one end of the spring case 12 is inserted through a hole 5-3 formed at a base of the reel groove 5-2 and then a distal end of the projection 12-3 is folded so as to fix the case to the reel 5.

Next, description is made on the operations of the recoil starter of the above arrangement according to the invention. Before starting, the recoil starter is in a stand-still state, wherein the ratchet 8 is meshed with the cam portion 3-1 of the cylinder cam 3, as shown in FIG. 3. Pulling the rope 6 in this state brings the reel 5 into rotation, while at the same time, the recoil spiral spring 10 and the power storage spiral spring 11 are also brought into rotation. Because of a rotation load of the engine, however, the power storage spiral spring 11 is unable to rotate the cylinder cam 3 until a certain amount of power is stored in the power storage spiral spring 11. There after when the power stored in the power storage spiral spring 11 overcomes the rotation load of the engine, the spring 11 rotates the cylinder cam 3 thereby bringing the cup-shaped pulley 7 and the crankshaft 14 into rotation via the ratchet 8 meshed with the cam portion 3-1 of the cam. Thus, the engine is activated. Subsequently, when the rope 6 is released, the ratchet 8 is moved to a position indicated by a dot-dash line in FIG. 3 by a centrifugal force associated with the rotation of the engine so that the ratchet is disengaged from the cam portion 3-1. When the engine is stopped, the ratchet 8 is returned by the return spring 9 to a state in which the ratchet 8 is meshed with the cam portion 3-1 of the cylinder cam 3. On the other hand, a cooling air for the engine is introduced from the air inlet ports 1-1*a*, 1-2*a* formed at the starter case 1, the air inlet port 5-1 formed at the reel 5 and that 12-1 formed at the spring case through the power storage spiral spring 11 and then to the engine, as indicated by arrowed lines in FIG. 1. It is noted that although dusts enter the recoil starter as borne on the cooling air for the engine, there is substantially no fear of dusts entering the one way clutch portion because the one way clutch portion, in particular, is disposed within the cup-shaped pulley 7 whereas the cam portion in engaging relation therewith is inserted in the pulley via the hole formed in the bottom of the pulley 7.

The aforementioned recoil starter employs the ratchet mechanism as the one way clutch mechanism, the ratchet mechanism wherein the ratchet 8 mounted to the cup-shaped pulley 7 on the engine side is releasably engaged with the cylinder cam 3. Alternatively, a recoil starter shown in FIGS. 8 to 10 employs, instead of the a fore said one way clutch mechanism, a ratchet mechanism wherein the ratchet mounted to the cylinder cam 3 side is releasably engaged with the cup-shaped pulley mounted on the engine side. The mechanism is arranged as follows. A ratchet 18 is pivotally mounted to a cylinder cam 13 and is formed with a projection 18-1. A friction plate 15 is formed with a guide groove 15-1 at an outer end thereof so as to guide the projection 18-1 for retracting or advancing movement of the ratchet 18. The friction plate 15 is mounted to the starter shaft 2 by means of the set screw 4. The rotation of the cylinder cam 13 brings the ratchet 18 into releasable engagement with any of a plurality of recesses 17-1 defined by an outer periphery and formed at an opening end of the cup-shaped pulley 17. It is noted that a friction spring 19 is wound around the friction plate 15 so as to produce friction between the friction plate 15 and the starter shaft 2 and hence, frictional resistance at a sliding portion is stabilized, resulting in smooth action .

The recoil starter operates as follows. First, in a stand-still state as shown in FIG. 10, pulling the rope 6 brings the reel 5 into rotation, while at the same time, the cylinder cam 13 and the ratchet 18 mounted thereto are also rotated. On the other hand, the friction plate 15 is inhibited from pivoting by the frictional resistance of the friction spring 19 so that the ratchet 18 is moved outwardly via the projection 18-1 along the guide groove 15-1 of the friction plate 15. As shown in FIG. 9, a distal end of the ratchet 18 projects outwardly from a circumferential edge of the friction plate 15 so as to engage with any one of the plural recesses 17-1 defined by the outer periphery and formed at the opening end of the cup-shaped pulley 17. Subsequently, both the friction plate 15 and the ratchet 18 are rotated in unison against the frictional resistance, thereby activating the engine Next, when the rope is released, the reel 5 is reversely rotated by means of the power storage spiral spring 11 so that the projection 18-1 moves inwardly along the guide groove 15-1 of the friction plate 15. Thus, the ratchet 18 is returned to its initial position, as shown in FIG. 10. In the stand-still state, the ratchet 18 is inhibited from pivoting by means of the projection 18-1 formed at the ratchet 18 and the guide groove 15-1 of the friction plate 15 and hence, there is no fear of the ratchet projecting outwardly due to vibrations or the like.

As mentioned supra, the invention presents the following effects.

1: The invention adopts the method wherein the cooling air for engine is introduced from the air inlet ports, formed at the starter case, reel and spring case, through the power storage spiral spring and then to the engine and hence, the engine is efficiently cooled.

2: The power storage spiral spring is accommodated in the spring case to form a cassette, which not only facilitates the fabrication and handlings (exchange and the like) of the spring but also contributes to enhanced assemblability and rigidity of the spring.

3: The one way clutch mechanism is disposed with in the cup-shaped pulley so that the clutch mechanism is less susceptible to dusts entering as borne on the cooling air flow.

4: The cam is mounted to the starter shaft unitary with the starter case whereby the rotation of the cam can be stabilized. Furthermore, the starter shaft has a smaller diameter at a shaft portion in engaging relation with the ratchet of the one way clutch mechanism so that the one way clutch mechanism as a whole can be reduced in size.

What is claimed is:

1. A recoil starter comprising:

a starter case unitary with a starter shaft disposed on an axis of a crankshaft in face-to-face relation therewith;

a one way clutch mechanism comprising a cylinder cam pivotally fitted on the starter shaft, a cup-shaped pulley mounted on an engine side, and a ratchet mechanism mounted to the pulley and brought into or out of engagement with the cylinder cam;

a reel pivotally mounted to the starter shaft;

a rope wound around a groove of the reel;

a recoil spiral spring anchored to the starter case and the reel at both ends thereof and biased in a direction to wind up the rope; and a power storage spiral spring accommodated in a cassette type spring case and operative to resiliently transmit a reel torque to the cylinder cam when the rope is pulled out, wherein air inlet ports for introducing a cooling air to said starter are disposed at an outside surface and outer periphery of the starter case, a side surface of the reel and a side surface of the spring case for the power storage spiral spring.

2. A recoil starter comprising:

a starter case unitary with a starter shaft disposed on an axis of a crankshaft in face-to-face relation therewith;

a one way clutch mechanism comprising a cylinder cam pivotally fitted on the starter shaft, and a ratchet mechanism in which a ratchet pivotally mounted to the cylinder cam is brought into or out of engagement with a cup-shaped pulley mounted on an engine side;

a reel pivotally mounted to the starter shaft;

a rope wound around a groove of the reel;

a recoil spiral spring anchored to the starter case and the reel at both ends thereof and biased in a direction to wind up the rope; and a power storage spiral spring accommodated in a cassette type spring case and operative to resiliently transmit a reel torque to the cylinder cam when the rope is pulled out, wherein air inlet ports for introducing a cooling air to said starter are disposed at an outside surface and outer periphery of the starter case, a side surface of the reel and a side surface of the spring case for the power storage spiral spring.

3. A recoil starter as claimed in claim 1, wherein a substantially U-shaped notch provided at an outer end of the power storage spiral spring is designed to engage with a projection formed by inwardly projecting a portion of a circumference of the spring case.

4. A recoil starter as claimed in claim 1, wherein a part of the cylinder cam pivotally fitted on the starter shaft is inserted in a central hole in a bottom of the cup-shaped pulley and wherein the ratchet of the one way clutch mechanism mounted within the cup-shaped pulley is deployed by a centrifugal force thereby to disengage from the cylinder cam.

5. A recoil starter as claimed in claim 1 or 2, wherein the starter shaft has a two step structure including a greater diameter portion closer to the reel and a smaller diameter portion defining a distal end portion of the shaft, and wherein the cylinder cam is pivotally fitted on the starter shaft as covering the smaller diameter portion and a part of the greater diameter portion.

6. A recoil starter as claimed in claim 2, wherein a substantially U-shaped notch provided at an outer end of the power storage spiral spring is designed to engage with a projection formed by inwardly projecting a portion of a circumference of the spring case.

7. A recoil starter as claimed in claim 1, 2, 3 or 4, wherein a projection formed at the spring case for the power storage spiral spring is inserted through the reel and fixed thereto by folding a distal end of the projection.

* * * * *

UNITED STATES PATENT AND TRADEMARK OFFICE

CERTIFICATE OF CORRECTION

PATENT NO. : 6,739,303 B2
DATED : May 25, 2004
INVENTOR(S) : Takayuki Harada et al.

It is certified that error appears in the above-identified patent and that said Letters Patent is hereby corrected as shown below:

Column 1,
Line 38, “apivotally” should read -- a pivotally --.

Column 2,
Line 63, insert a period -- . -- at the end of the paragraph after “portion” (second occurrence).

Column 3,
Line 17, “state of there coil starter” should read -- state of the recoil starter --.
Line 63, “formed data slope” should read -- formed at a slope --.

Column 4,
Line 1, “crank chaft” should read -- crankshaft --.
Line 4, after “portion 2-2” insert a period -- . --.
Line 21, “there with. There coil spiral” should read -- therewith. The recoil spiral --.
Line 67, “There after” should read -- Thereafter --.

Column 5,
Line 30, “a fore said” should read -- aforesaid --.
Line 63, insrt a period -- . -- at the end of the paragraph after “engine”.

Column 6,
Line 18, “disposed with in” should read -- disposed within --.

Column 8,
Line 13, “claim 1, 2, 3 or 4” should read -- claim 1, 2, 3 or 6 --

Signed and Sealed this

Eleventh Day of January, 2005

JON W. DUDAS
*Director of the United States Patent and Trademark Office*